US009677863B1

(12) United States Patent
Palathingal et al.

(10) Patent No.: US 9,677,863 B1
(45) Date of Patent: Jun. 13, 2017

(54) LONG ROD PENETRATOR CONCEPT FOR SMALL CALIBER MUNITIONS

(71) Applicant: The United States of America as Represented by the Secretary of the Army, Washington, DC (US)

(72) Inventors: Mohan J. Palathingal, Oradell, NJ (US); Kip Hess, Sparta, NJ (US); Gregory M. Kolasa, Wantage, NJ (US); Sung Chung, Dover, NJ (US); Marco Duca, Mt. Arlington, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/006,679

(22) Filed: Jan. 26, 2016

(51) Int. Cl.
*F42B 14/06* (2006.01)

(52) U.S. Cl.
CPC ..... *F42B 14/061* (2013.01); *F42B 14/062* (2013.01); *F42B 14/068* (2013.01)

(58) Field of Classification Search
CPC ..... F42B 14/06; F42B 14/064; F42B 14/067; F42B 14/061–14/062; F42B 14/068
See application file for complete search history.

(56) References Cited

U.S. PATENT DOCUMENTS 1,475,578 A * 11/1923 Hadfield ..... F42B 14/02 102/526
3,148,472 A * 9/1964 Hegge ..... F42B 14/02 102/521
3,613,584 A * 10/1971 Hendricks ..... F42B 14/06 102/439
4,284,008 A * 8/1981 Kirkendall ..... F42B 14/02 102/501
4,730,561 A * 3/1988 Schaake ..... F42B 10/06 102/517
5,063,855 A * 11/1991 Diel ..... F42B 14/062 102/521
5,289,777 A * 3/1994 Sippel ..... F42B 14/061 102/521
5,359,938 A * 11/1994 Campoli ..... F42B 14/061 102/521
6,540,176 B2 * 4/2003 Davis ..... F42B 10/48 102/347
6,662,726 B1 * 12/2003 Steiner ..... F42B 12/06 102/517

(Continued)

FOREIGN PATENT DOCUMENTS

FR DE 3021914 A1 * 9/1983 ..... F42B 14/061

OTHER PUBLICATIONS

Espacenet, Machine translation of DE 3021914 A1.*

*Primary Examiner* — Stephen M Johnson
*Assistant Examiner* — Joshua Semick
(74) *Attorney, Agent, or Firm* — Michael Sachs

(57) ABSTRACT

A kinetic energy penetrator for use in small caliber ammunition, which penetrator can utilize composite material small sabots. A large shear area in the sabot having a small number of decreasingly sized buttress grooves, mate to the penetrator shaft making use of composite material sabots feasible. Lightening of the penetrator through substitution of composite material sabots results in greater velocity with higher kinetic energy on lethal impact. The fewer grooves aerodynamically lessen drag and likewise tend to boost velocity plus lethal impact.

7 Claims, 9 Drawing Sheets

(56) References Cited

U.S. PATENT DOCUMENTS

| | | | | |
|---|---|---|---|---|
| 6,684,792 | B2 * | 2/2004 | Denis | F42B 30/02<br>102/507 |
| 7,036,434 | B1 * | 5/2006 | Vo | F42B 14/06<br>102/503 |
| 7,594,472 | B1 * | 9/2009 | Parratt | F42B 14/068<br>102/520 |

* cited by examiner

LONG ROD PENETRATOR CONCEPT FOR SMALL CALIBER MUNITIONS

U.S. GOVERNMENT INTEREST

The inventions described herein may be made, used, or licensed by or for the U.S. Government for U.S. Government purposes.

BRIEF SUMMARY OF THE INVENTION

It is sought to provide a small caliber KE ammunition of even sniper ammunition capability which can defeat vehicles and other such hard targets. A problem is to lighten the round components by utilizing composite material sabots. Weight reduction can add velocity and lethality to the round's KE penetrator. However, successful attachment of such sabot materials to a small caliber KE penetrator raises many challenges.

BACKGROUND OF THE INVENTION

With reference to FIGS. 1 and 2 hereof, kinetic energy (KE) projectiles (100) may be used to defeat light and heavy vehicle armor. KE projectiles (100), include a KE penetrator rod (102) which is threaded to a front nose (101) and a fin (103) in the rear. A sabot (104) is attached to the penetrator rod (102) by the pressure flanks or thread like buttress grooves (105). There may be 2 or 3 sabot petals (104). The penetrator rod (102) may be placed against each sabot buttress groove 105, (see FIG. 2, holding the sabot (104) tightly against the rod (102). A breakaway snap ring may be added to the front and rear of the sabots to hold the assembly together. The KE projectile (100) can be attached to a cartridge case containing propellant (not shown), (101+102+103) by a snap joint (106) or other mechanism at the rear of the saddle. Upon gun launch the snap rings would break and allow the sabot parts (104) to move away from the in-flight KE projectile (101+102+103) and impact the ground a short distance from the gun. The in-flight KE projectile (101+102+103) continues on to the target and defeats the target by rapid penetration (kinetic energy) through the armor, e.g. The interface between the KE rod (102) buttress grooves (105) and the matching sabot buttress grooves (105) is important during the period the projectile travels down the bore of the gun. The buttress grooves carry the mass of the KE rod (102) and nose (101) and if not properly designed, the projectile would shear during launch and result in overall structural failure of the projectile. It can be seen that a substantial quantity of matching buttress grooves (105) are used to support the sabot(s) (104), KE rod (102) and nose (101). The numerous number of grooves (105) are needed to ensure an even distribution of projectile load forces over the buttress grooves. Moreover, the sabot (104) shown, which is desired to now be made of lightweight composite (carbon fibers in epoxy matrix), conventionally was made of aluminum. The replacement of aluminum sabots with composites would result in significant parasitic weight reduction, which in turn result in higher velocities of the projectile for a given propelling charge, and ultimately greater lethality on a target. The composite sabots as to be designed here are stronger than their aluminum counterparts particularly in tensile load carrying sections of the sabot, but have a lower shear carrying capability therefore resulting in relatively weaker buttress grooves. The problem of poor shear carrying capability in the buttress grooves gets worse when the projectile being designed is of very small calibers (e.g., sniper ammunition size), because the groove sizes start to approach the sizes of the fibers being used in the composite sabot. Also, the conventional groove design, when scaled down possesses very sharp features, which exacerbate the problem by creating stress concentrations in the composite sabot grooves.

On some KE projectiles, a tipping ring is needed to allow the sabots to move outward as the sabots peel off the projectile, so that the sabots do not strike the fin when they are discarded. The tipping ring is usually at the end of the buttress grooves at the fin end, and is usually larger than the buttress grooves. It is another component that adds weight and financial cost to the overall projectile.

In order for the in-flight KE projectile (101+102+103) to be launched properly as a small caliber, e.g, fly well, and defeat the target, several features need to be accomplished. They are as follows:

1) The sabots (104)/rod (102) interface needs enough buttress grooves to support the penetrator during launch.
2) The buttress grooves (105) should be small enough in order to keep the drag of the projectile low enough to ensure high striking velocity on target.
3) A tipping ring may need to be added to ensure proper sabot discard after the projectile exits the muzzle of the gun.
4) The desired location of the center of gravity should be made usually toward the front of the projectile to enhance its flight stability which in turn helps improve its accuracy.

What is needed is a new way to attach the sabots to a small penetrator, particularly when opting to use a composite sabot, to reduce costs, reduce the number of complex features like buttress grooves, to maintain clean sabot discard, and to improve the stability of the flight projectile by moving the center of gravity forward. This invention solves all these problems.

OBJECTS OF THE INVENTION

Accordingly, it is an object of the present invention to provide a kinetic energy projectile for use in a small ammunition sniper size, used to defeat light and heavy vehicle armor.

It is a yet another object of the present invention to provide a small caliber KE projectile ammunition of enhanced velocity and lethality, used to defeat light and heavy vehicle armor.

Another object of the invention is to provide a small ammunition size kinetic energy projectile utilizing a sabot made of composite fiber materials in an epoxy base.

It is a further object of the present invention to provide a small ammunition size kinetic energy projectile employing buttress grooves with tapered design steps which provide a large shear area at the buttress grooves.

It is a yet another object of the present invention to provide a small caliber KE projectile ammunition having a penetrator with a long aft section that minimizes interaction of a sabot with a fin section during a sabot discard event.

It is a still another object of the present invention to provide a small caliber KE projectile ammunition having a penetrator which eliminates the need for a tipping ring on a fin section to save on projectile weight and eliminating the complexity of such ring.

It is a still further object of the present invention to provide a small caliber KE projectile ammunition with less aerodynamic drag due to many fewer grooves than were previously contemplated.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

INVENTION DESCRIPTION

Figure 1:
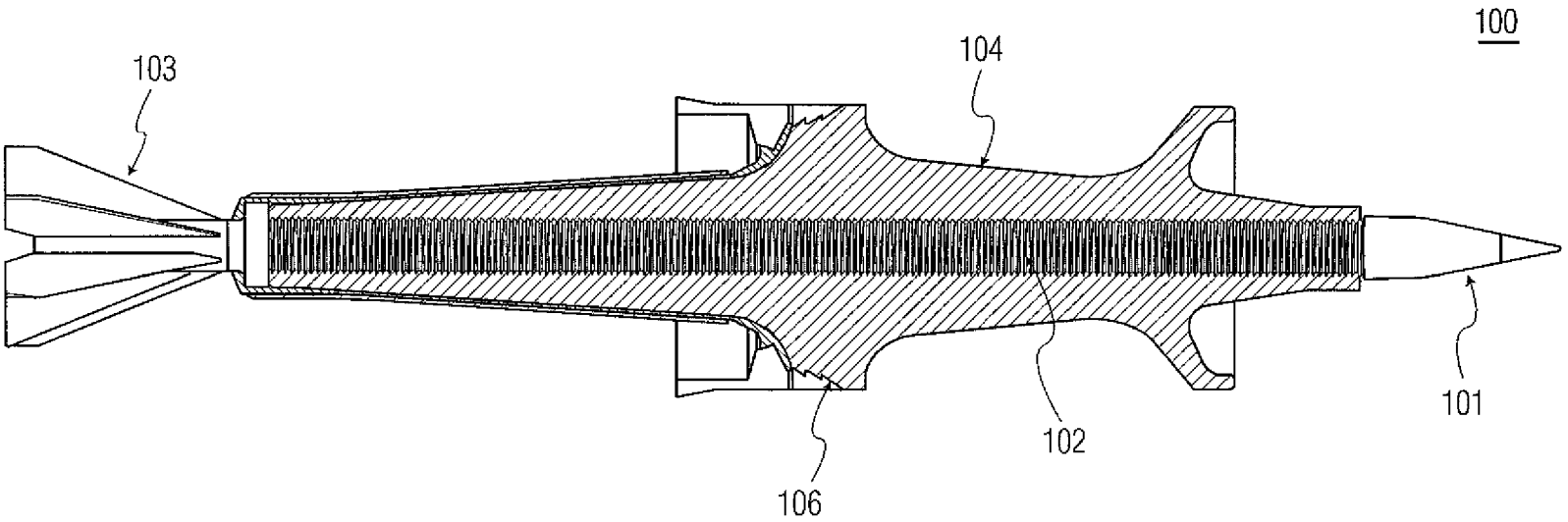
FIG. 1 shows a cutaway model of a conventional kinetic energy cartridge.
Figure 2:
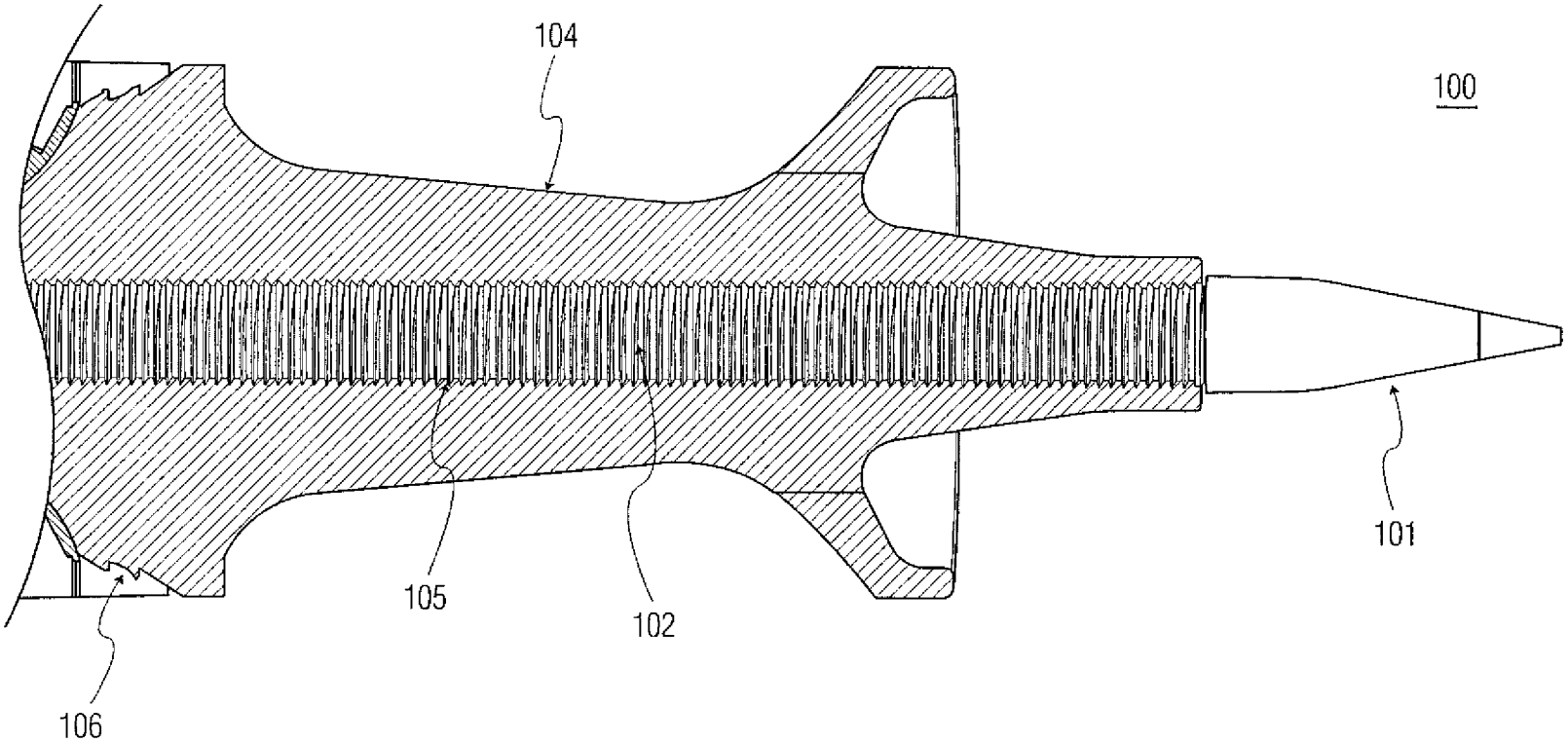
FIG. 2 shows a cutaway model of one conventional KE cartridge showing a buttress interface between sabot and the penetrator rod.
Figure 3:
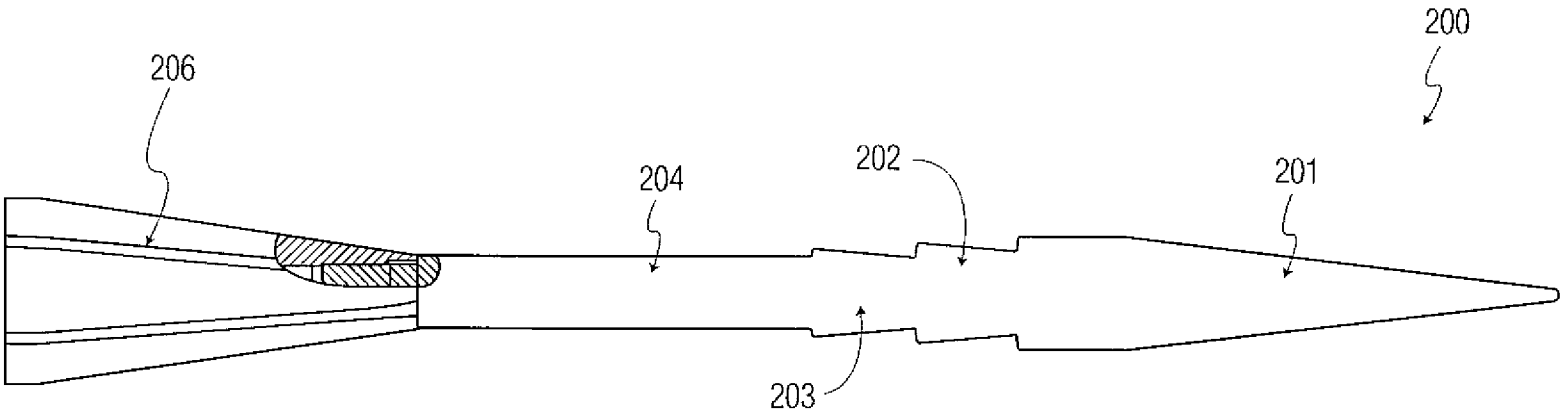
FIG. 3 shows a model of an improved inflight KE projectile design according to this invention.

FIG. 3 shows the improved in-flight KE projectile design (200) with improved buttress groove sections (202+203). The nose (201) may be threaded on to projectile rod (204) or become one piece (201+204). The conventional straight penetrator with numerous equal diameter buttress grooves is now replaced by a penetrator with the same overall length but with fewer grooves, which have slightly decreasing major diameters as one progresses from the nose of the penetrator towards the fin side. For purposes of this specification and claims, the terms "major diameter" "major diameter axis", or "major axis diameter", may be used interchangeably and shall mean: the largest diameter of each of the buttress projections as measured at the crest of each of the projections. The fewer grooves decrease aerodynamic drag. Every attempt is made to lighten the projectile shaft (800). This is because kinetic energy is directly proportional to the square of the velocity of the flying KE shaft. Therefore, lightening the weight of the shaft (which inversely increases the velocity) will increase kinetic energy, hence its striking power. The grooves' front end is nearly vertical (just 7 degrees off a vertical in one embodiment). This FIG. 3 arrangement creates a larger shear area in the matching composite sabot side of the groove. This allows the composite sabot to carry a larger shear load in the buttress grooves, despite its lower shear properties. The relief(s) on the grooves are flatter (actually 86 degrees off a vertical in one embodiment), which allow the sabot(s) to separate cleanly from the projectile rod (204). In addition, this new geometry shifts the center of gravity of the penetrator towards the nose, thereby improving the projectile stability. In addition during the sabot discard event after muzzle exit, the longer aft section of the penetrator allows the sabots ample time to move laterally away from the projectile body, minimizing the potential for striking the fin. This helps eliminate another source of inaccuracy for the flight projectile and also the need for a tipping ring.

Figure 4:
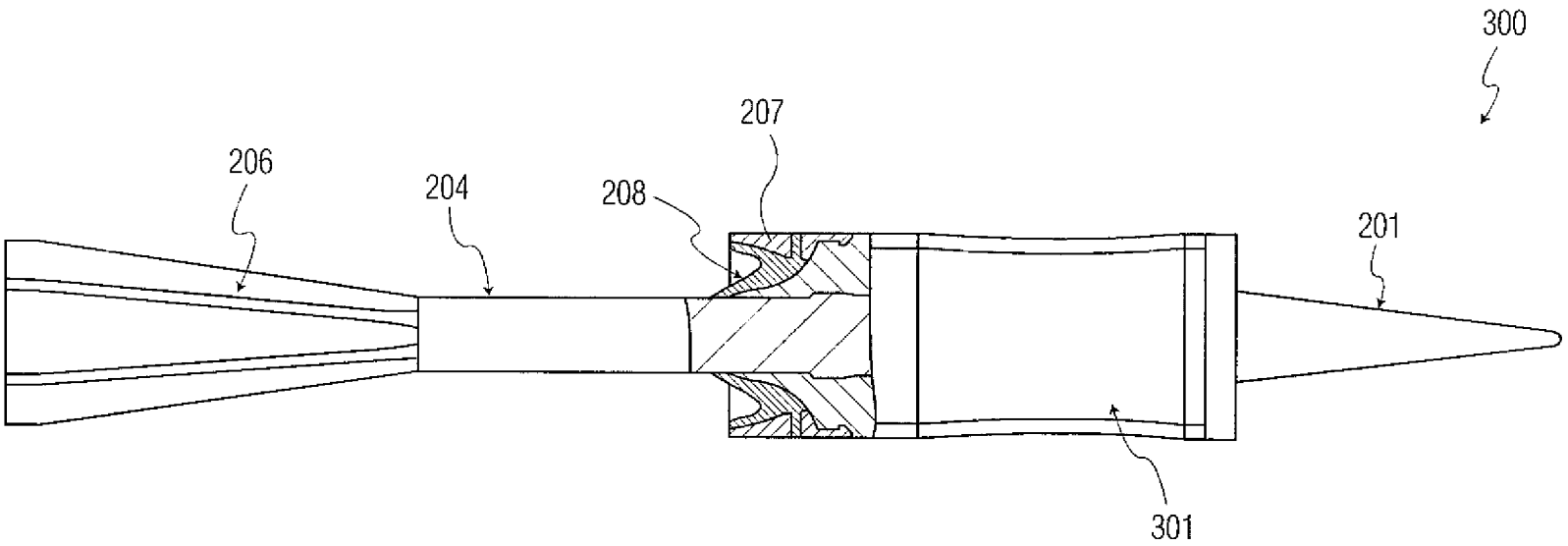
FIG. 4 shows a cutaway of an improved in bore KE projectile according to this invention.
Figure 5:
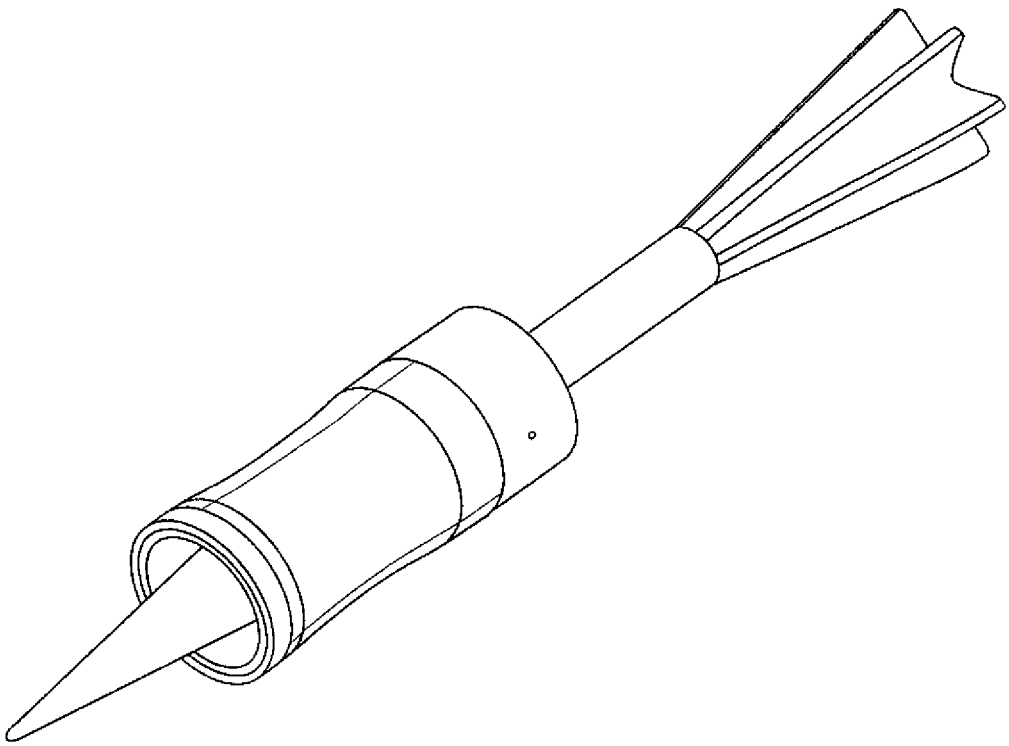
FIG. 5 shows an exterior view of an assembled KE projectile according to this invention.

FIG. 4 is a cutaway of the in-bore projectile. It consists of the fins (206), penetrator rod (204), matching sabot (301), obturator (207), seal (208), and nose (201). FIG. 5 shows an exterior view of an assembled projectile. The U. S. Army ARDEC has successfully tested an improved in flight projectile according to this invention at the Armament Technology Facility (ATF) at Picatinny Arsenal, N.J.

Figure 6:
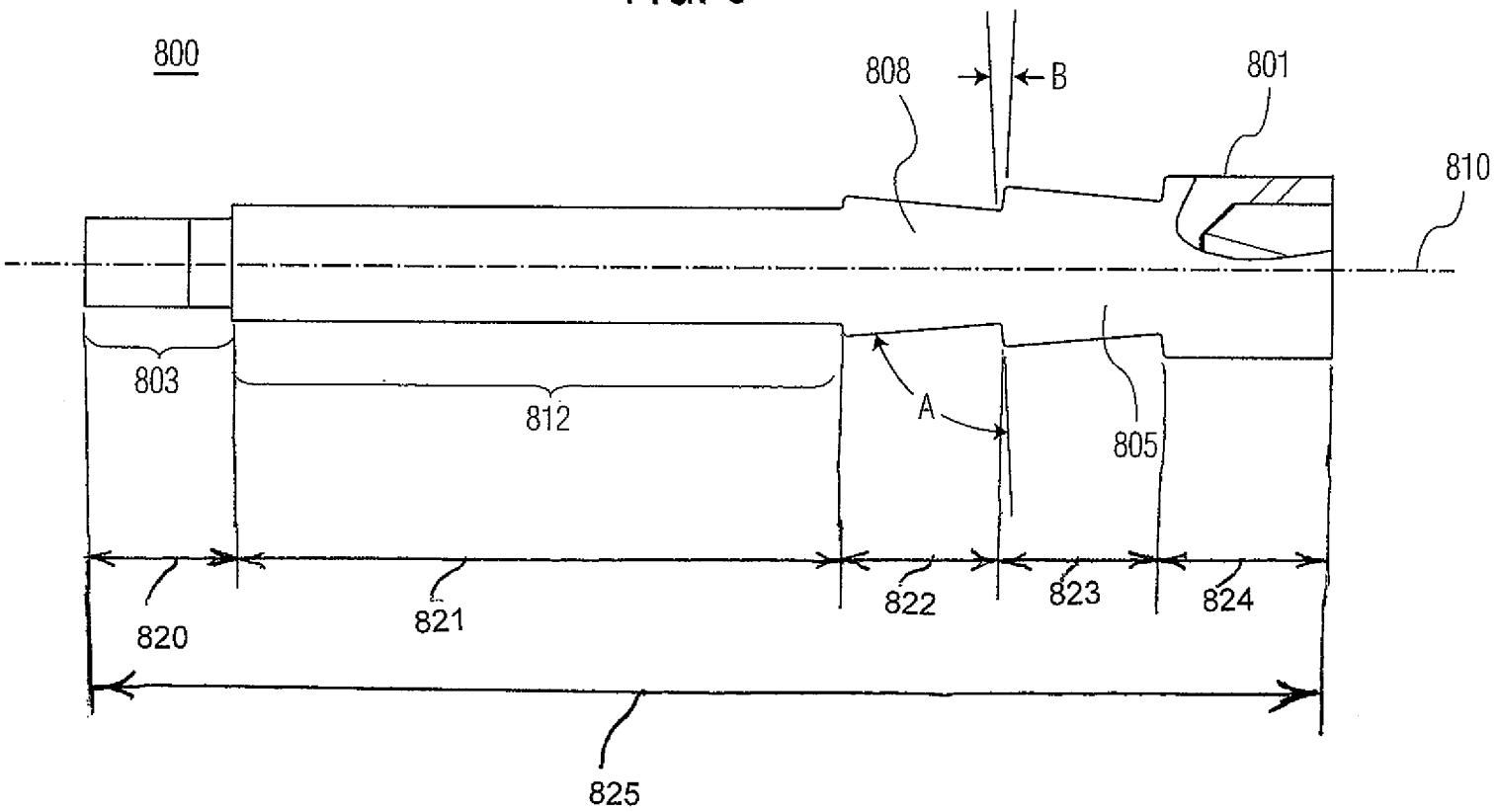
FIG. 6 shows the KE projectile shaft according to this invention.
Figure 7:
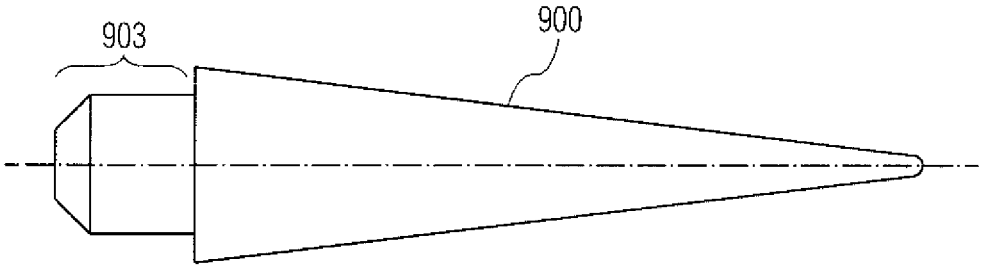
FIG. 7 shows a front nose cone for the KE projectile shaft according to this invention.
Figure 8:
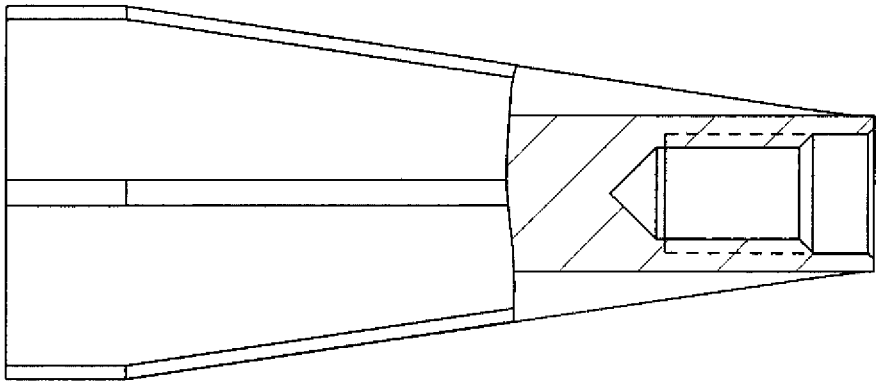
FIG. 8 shows an attachable fin assembly for the KE projectile shaft according to this invention.
Figure 9:
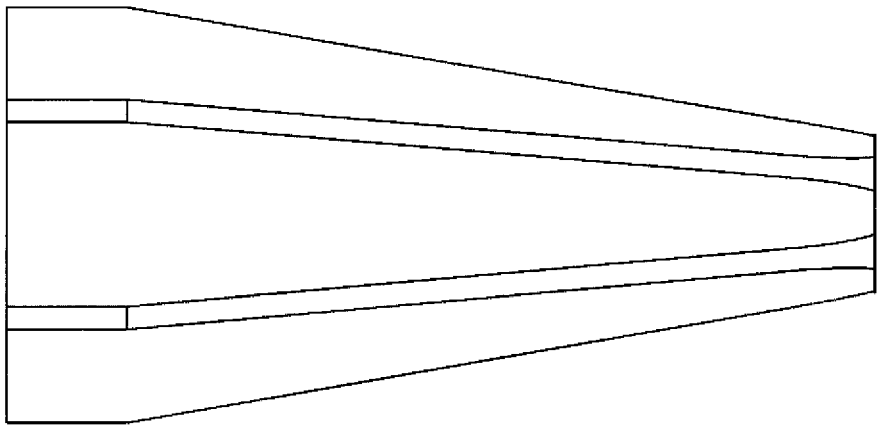
FIG. 9 shows another view of an attachable fin assembly for the KE projectile shaft according to this invention.
Figure 10:
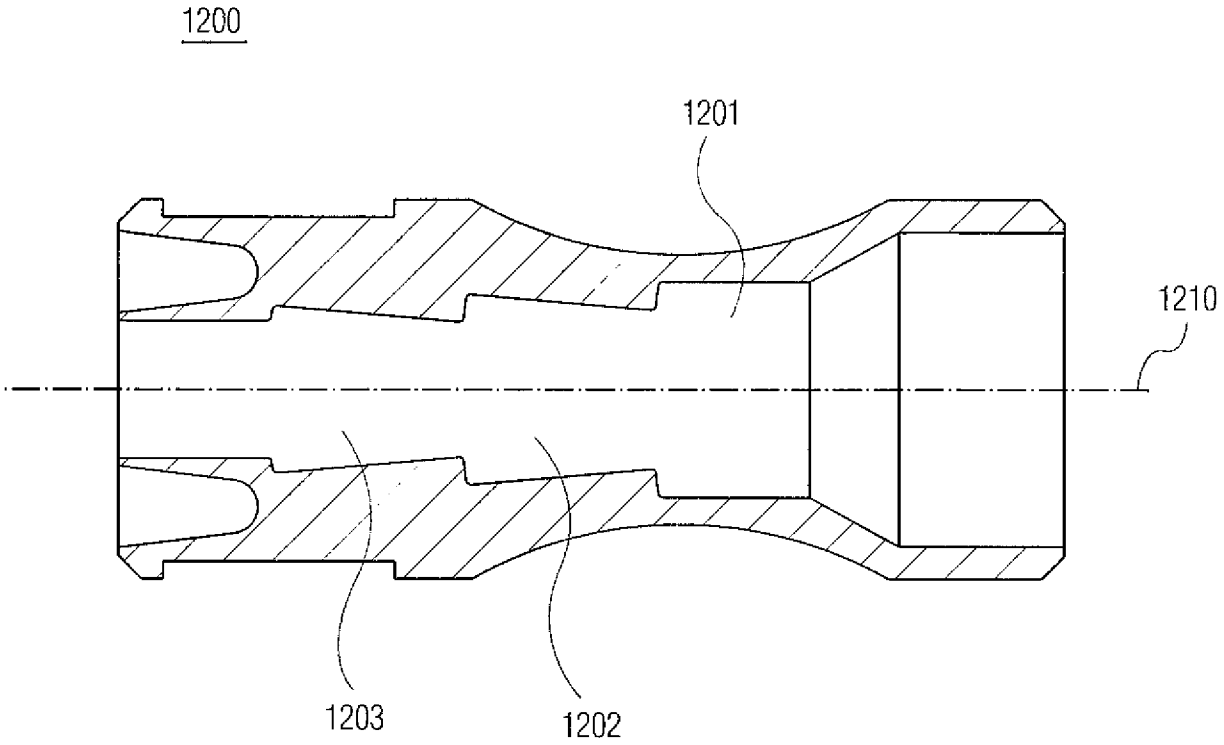
FIG. 10 shows a sabot for use with the KE projectile shaft according to this invention.
Figure 11:
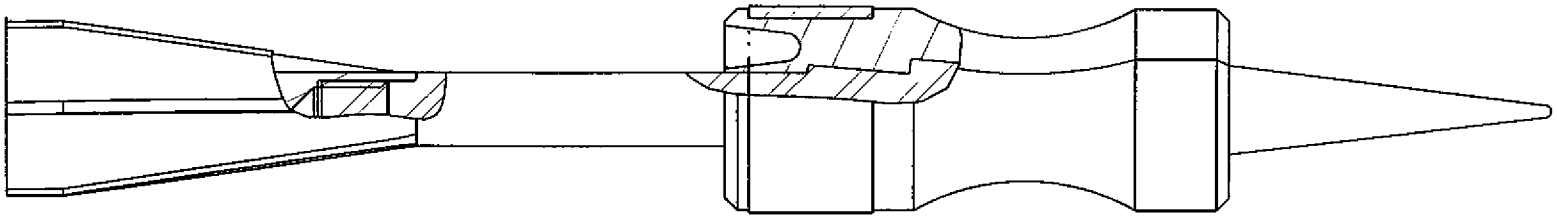
FIG. 11 shows a view of an assembled KE projectile according to this invention.

FIGS. 6 through 11 show a more detailed view of the KE penetrator 800 (also called 'the projectile shaft' at places herein). Dimensions, ratios, angles could vary for sabot material; here described is for a carbon fiber composite in epoxy material sabot. The Figures are not in perfect proportions, or done to scale. FIG. 6 shows the projectile shaft 800. At the front end is a cylindrical section 801 (which has a length 824) into which front cone like section 900 (FIG. 7) may be screwed in to post 903 (screw threads not shown). The shaft 800 has a rear post 803 (of length 820) to facilitate attachment of a rear fin assembly such as shown in FIGS. 8 and 9. Proximately behind cylindrical section 801, groove sections 805, 808 are found. The grooves here go in a left stepwise direction, having descending major diameter axes. Two groove sections are shown but theoretically, more could be added. The back end of each groove is nearly vertical with respect to long axis 810 of the shaft; actually they lean back by angle B which here may be 7 degrees. The relief sections of each groove are almost flat; here they rise up by angle A (with respect to long axis 810 of the shaft) which here may be 86 degrees. First groove 805 has length 823 and second groove 808 has length 822. FIG. 10 shows a cutaway of the sabot 1200. Cylindrical section 801 of shaft 800 would fit in area 1201 of the sabot; groove 805 would fit into area 1202 of the sabot; and groove 808 would fit into area 1203 of the sabot. The sabot is made to completely mate with the shaft, buttress grooves and so forth. FIG. 11 gives an idea of a fully assembled KE projectile. In one example of a KE projectile the major axis diameter of each successive buttress groove in the direction further from the nose cone is about 88% of the major axis diameter of its previously positioned adjacent groove. The long part 812 of the axis, has a smaller diameter than any of the buttress grooves. The front cylindrical section 801 has the largest diameter on the axis. Returning to FIG. 6, in one example of a KE projectile, the entire length (825=820+821+822+823+824) of the KE projectile shaft part thereof 800 is about 1.95 inches. The length (822+823) of the full section of the KE projectile shaft which includes all buttress grooves (here 805, 808) is about 0.550 inches, being less than about 29% of the length of the entire shaft 800. In one example of a KE projectile, proximately following the back of said front nose cone section there is a straight cylindrical portion 801 along the KE projectile shaft which portion is about 0.264 inches, this length 824 being less than about 14% of the length of the entire shaft 800, and then proximately following such cylindrical portion of the shaft is the section of the shaft which includes the buttress grooves, here 805, 808. In one example of a KE projectile, from the back of said front nose cone section, to the end of the section of the KE projectile shaft which includes the grooves 805, 808, less than about 42% of the entire shaft length is accounted for, leaving a long empty section (812 having length 821) of the shaft 800 of about 58% leading back as far as to the fin assembly location that starts at plug 803 area. In one example of a KE projectile, the length of the sabot is about 1.228 inches, however not all of the sabot is actually directly on or a part of the KE projectile shaft, though the buttresses mate there. Sabot sections jut outwards and side wards from the shaft at certain locations. Nonetheless, the sabot as a piece is mounted on to be joined onto the finally assembled KE projectile. In one example of a KE projectile, the length of the fin assembly (FIG. 8, 9) is 1.00 inch; it is screwed in or otherwise attached at the end of the shaft at 803 (threading or attachment means not shown). The fin assembly is not a part of the KE projectile shaft, but it is a part of the (assembled) overall KE projectile. In one example of a KE projectile, the length of the nose cone 900 is 1.049 inches when part 903 is screwed in or otherwise attached at the front end of the KE projectile shaft (attachment means not shown). The nose cone is not here a part of the KE projectile shaft, but it is a part of the (assembled) overall KE projectile. The following may be included among the accomplishments of the invention. Shown here is an improved small ammunition (sniper round possible) penetrator shaft, barely 2 inches long (in parts), which can still be used to defeat light and heavy vehicle armor in combat. Shown herein are new improved buttress grooves with a tapered design, with steps, that provide a large shear area at the buttress grooves. The larger shear area enables use of small composite sabots, for these small caliber kinetic energy penetrator ammunition rounds, something not here before accomplished. Shifting of the KE projectile's center of gravity forward towards the nose of the penetrator rod has proven advantageous to improve flight stability, and therefore accuracy. The geometric shift of the sabot center of mass away from the longitudinal axis of the penetrator is an advantage. It assists in assuring that sabot portions have less possibility of interaction with the fin section during a sabot discard event. The long groove-less aft section 812 of the penetrator 800 minimizes the possibility of interaction of the sabot with the fin sections during the sabot discard event, thereby eliminating the need for a tipping ring on the fin section. This saves the weight and complexity of a tipping ring. There is less aerodynamic drag due to smaller and fewer grooves than as were used before on KE projectile shafts for larger caliber rounds, e.g. Therefore the KE axis ultimately can move faster and with more lethality.

While the invention may have been described with reference to certain embodiments, numerous changes, alterations and modifications to the described embodiments are possible without departing from the spirit and scope of the invention as defined in the appended claims, and equivalents thereof.

What is claimed is:

1. In a munition, a single piece KE projectile with a defined long axis (810) wherein the KE projectile comprises; a KE projectile shaft (800) with a straight cylindrical portion (801) at a front end of the KE projectile shaft, wherein a diameter of said straight cylindrical portion (801) is the largest diameter of said KE projectile shaft, and wherein proximately following said straight cylindrical portion, the KE projectile shaft includes a plurality of buttress grooves (202) and (203) in stepped fashion, wherein a major diameter of each successive buttress groove is progressively smaller than the major diameter of a previously positioned adjacent buttress groove, and wherein each buttress groove's back end is vertical with respect to said defined long axis, and wherein a relief section of each buttress groove is horizontal with respect to said defined long axis.

2. The KE projectile of claim 1 wherein the plurality of buttress grooves is two buttress grooves.

3. The KE projectile of claim 1 wherein said KE projectile shaft is mated with an attachable sabot (301) comprised of composite carbon fiber materials in epoxy matrix and which sabot (301) has interior grooves which directly mate to the buttress grooves on the said KE projectile shaft (800).

4. The KE projectile of claim 3 wherein the sabot (301) is comprised of 2 or 3 petals held together around the KE projectile shaft and having buttress grooves shaped to fully mate to the KE projectile shaft's grooves.

5. The KE projectile of claim 4 wherein the sabot (801) has an obturator and a seal.

6. The KE projectile of claim 1 wherein said KE projectile shaft (800) further comprises an attachable fin assembly (206).

7. In a munition, a single piece KE projectile with a defined long axis (810) wherein the KE projectile comprises; a KE projectile shaft (800) with a straight cylindrical portion (801) at a front end of the KE projectile shaft, wherein said straight cylindrical portion (801) is the largest diameter part of said KE projectile shaft, and wherein proximately following said straight cylindrical portion, the shaft includes two or more buttress grooves (202) and (203) in stepped fashion, wherein a major diameter of each successive buttress groove is progressively smaller than the major diameter of a previously positioned adjacent buttress groove, and wherein the buttress grooves are succeeded by a portion (812) of the shaft having a diameter less than that of any of the buttress grooves, and wherein each buttress groove's back end is reclined toward the direction of the straight cylindrical portion (801) at an angle B of about 7 degrees off a perpendicular with respect to said defined long axis (810), and wherein a relief section of each buttress groove declines at an angle A of about 86 degrees off said perpendicular with respect to said defined long axis (810).

* * * * *